US010178465B2

(12) United States Patent
Grell et al.

(10) Patent No.: US 10,178,465 B2
(45) Date of Patent: Jan. 8, 2019

(54) HEADPHONE UNIT

(71) Applicant: Sennheiser electronic GmbH & Co. KG, Wedemark (DE)

(72) Inventors: Axel Grell, Burgdorf (DE); Manfred Hibbing, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/386,146

(22) Filed: Dec. 21, 2016

(65) Prior Publication Data

US 2017/0180845 A1 Jun. 22, 2017

(30) Foreign Application Priority Data

Dec. 22, 2015 (DE) ..... 10 2015 122 524

(51) Int. Cl.

| | |
|---|---|
| ***H04R 1/10*** | (2006.01) |
| ***H04R 5/04*** | (2006.01) |
| *H04R 5/033* | (2006.01) |
| *H04R 19/02* | (2006.01) |

(52) U.S. Cl.

CPC ..... *H04R 1/1091* (2013.01); *H04R 5/04* (2013.01); *H04R 5/033* (2013.01); *H04R 19/02* (2013.01)

(58) Field of Classification Search

CPC .. H03F 2200/03; H03F 1/0211; H03F 1/0222; H03F 1/0227; H03F 1/0233; H03F 1/2038; H03F 1/0244; H03F 1/04; H03F 1/07; H03F 1/16; H03F 1/24; H03F 1/28; H03F 1/307; H03F 1/3217; H03F 1/3264; H03F 1/327; H03F 1/33; H03F 1/40; H03F 1/50; H03F 1/54; H04R 2420/00; H04R 2420/01; H04R 2420/03; H04R 2420/09; H04R 2430/00; H04R 1/1091; H04R 10/00; H04R 10/005; H04R 10/01; H04R 10/013; H04R 10/02; H04R 10/08

USPC ... 381/28, 102, 120, 74, 309, 312–323, 116, 381/191; 330/139; 700/94

See application file for complete search history.

(56) References Cited

U.S. PATENT DOCUMENTS 2,962,562 A * 11/1960 McCarrell ..... G02C 11/06 381/161
4,654,883 A * 3/1987 Iwata ..... H04B 1/385 379/430

(Continued)

FOREIGN PATENT DOCUMENTS

| | | |
|---|---|---|
| DE | 43 29 991 | 3/1995 |
| DE | 4329991 A1 * | 3/1995 |
| DE | 44 26 696 | 1/1996 |

*Primary Examiner* — Leshui Zhang
(74) *Attorney, Agent, or Firm* — Haug Partners LLP

(57) ABSTRACT

A headphone unit comprising a headphone, a headphone pre-amplifier for pre-amplification of an audio signal to be reproduced, and a cable between the headphone pre-amplifier and the headphone. The headphone has two symmetrically designed electrostatic transducers in the push-pull mode of operation. The pre-amplifier is adapted to output an audio signal to be reproduced by way of a first amplifier stage as a voltage-amplified audio signal at an output. The headphone has second amplifier stages which are in the form of high-voltage amplifier stages which are supplied by way of the cable with a pre-amplified audio signal to be reproduced and a high-voltage supply.

8 Claims, 1 Drawing Sheet

(56) References Cited

U.S. PATENT DOCUMENTS

| | | | | |
|---|---|---|---|---|
| 2004/0157649 | A1* | 8/2004 | Jannard | G02C 11/06 455/569.1 |
| 2008/0101629 | A1* | 5/2008 | Carey | G10H 3/187 381/120 |
| 2010/0092010 | A1 | 4/2010 | Lee | |
| 2012/0289162 | A1* | 11/2012 | Hosoi | H04R 25/606 455/41.3 |
| 2014/0072139 | A1* | 3/2014 | Yin | H04R 3/00 381/74 |
| 2016/0246059 | A1* | 8/2016 | Halpin | G02B 27/0176 |

* cited by examiner

HEADPHONE UNIT

The present application claims priority from German Patent Application No. 10 2015 122 524.7 filed on Dec. 22, 2015, the disclosure of which is incorporated herein by reference in its entirety.

FIELD OF THE INVENTION

It is noted that citation or identification of any document in this application is not an admission that such document is available as prior art to the present invention.

The present invention concerns a headphone unit.

Headphones with an electrostatic push-pull transducer have long been known.

DE 4 329 991 B4 shows in FIG. 4b a headphone unit having an electrostatic push-pull transducer in accordance with the state of the art. The electrostatic push-pull transducer has an electrically chargeable diaphragm and two counter-electrodes which can be acted upon by highly amplified signal voltages and between which the diaphragm is vibratingly disposed. In addition there is provided a feed line for the polarization voltage and the highly amplified signal voltages. The headphone unit further has a separate high-voltage amplifier driven by a power supply to provide the highly amplified signal voltages which are operative at the two counter-electrodes. The headphone unit further has feed lines for the as yet unamplified signal voltages and also as feed lines for the power supply of the high-voltage amplifier.

With that headphone actuation of the electrostatic transducer has to be effected by way of a separate high-voltage amplifier by way of feed lines. The capacitances of the feed lines however can give rise at high frequencies to additional reactive currents which can be a multiple of the reactive currents of the electrostatic transducers. The longer the feed lines are, the correspondingly higher is the reactive power. Those currents have to be additionally applied by the high-voltage amplifier so that additional power implementation is involved.

In accordance with DE 4 329 991 that disadvantage is overcome by the high-voltage amplifier being integrated in the headphone. As a result the feed lines to the electrostatic transducer can be so greatly reduced in length that the reactive currents produced thereby are comparatively slight in relation to the reactive currents of the transducers and the additional power implementation is comparatively low.

In accordance with DE 4 329 991 actuation of the headphone amplifier is effected by audio signals with normal signal voltages. For providing the required signal amplification the high-voltage amplifier is provided in the headphone, which must permit a very high gain to produce the voltage required for operation of the electrostatic transducer. By virtue of that high gain however non-linear signal distortion phenomena can occur. Signal distortion phenomena of that kind can adversely affect the audio quality of the audio signal to be reproduced.

In the German patent application from which priority is claimed the German Patent and Trade Mark Office searched the following documents: DE 44 26 696 C1, DE 43 29 991 B4 and US 2010/0092010 A1.

SUMMARY OF THE INVENTION

Therefore an object of the present invention is to provide a headphone which permits reduced signal distortion.

Thus there is provided a headphone unit having a headphone, a headphone pre-amplifier having at least one tube for pre-amplification of an audio signal to be reproduced (which generally comprises two separate stereo signal components—one for the right-hand reproduction transducer and one for the left-hand reproduction transducer) and a cable between the pre-amplifier and the headphone. The headphone has two symmetrically designed electrostatic transducers in the push-pull mode of operation. The pre-amplifier is adapted to output an audio signal to be reproduced by way of a first amplifier stage as a voltage-amplified audio signal at an output to which a jack of the cable if connected. The headphone has second amplifier stages which are in the form of high-voltage amplifier stages which are supplied by way of the cable with a pre-amplified audio signal to be reproduced and a high-voltage supply.

Thus there is provided a headphone pre-amplifier having tubes, wherein the pre-amplifier serves for pre-amplification of the audio signal to be reproduced. To avoid the pre-amplifier also having to drive the cable a part of the amplifier, more specifically in particular the second amplifier stages, are provided not in the pre-amplifier but in the headphone.

According to an aspect of the present invention the cable has four wires, wherein two wires serve for the transmission of the pre-amplified audio signal and two wires serve for the voltage supply of the second high-voltage amplifier stage.

According to a further aspect of the present invention two oppositely directed symmetrical signal voltages are provided by way of the cable for each electrostatic transducer.

The invention concerns the notion of providing the electrostatic transducer with a high-voltage amplifier directly in the headphone. According to the invention there is provided a pre-amplifier or a first amplifier stage which is then coupled to the headphone by way of the headphone cable. Provided in the headphone is a second amplifier stage which is in the form of a high-voltage amplifier stage.

According to an aspect of the present invention the headphone cable has four wires, namely two for the audio signal and two wires for the high-voltage supply for the second amplifier stage.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
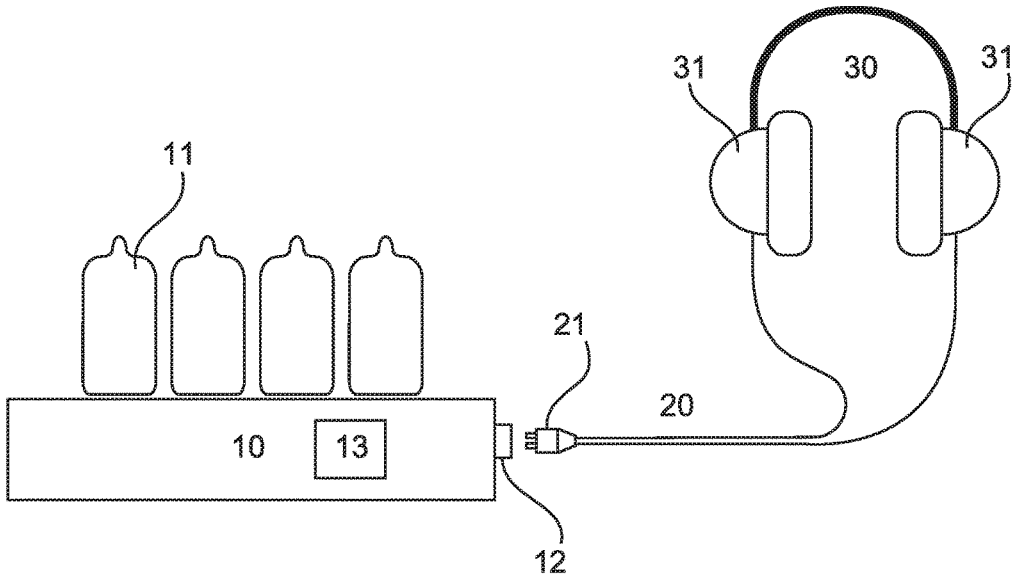
FIG. 1 shows a diagrammatic view of a headphone with a pre-amplifier.

FIG. 1 shows a diagrammatic view of a pre-amplifier and a headphone. The pre-amplifier 10 can be for example in the form of a tube amplifier having a plurality of tubes 11. As an alternative thereto the arrangement may also have an amplifier having transistors. The pre-amplifier 10 has a first amplifier stage 13, and a connection 12 for a jack 21 of a cable 20 of a headphone 30. The pre-amplifier 10 outputs both an audio signal A and also a high-voltage supply HVSV. The cable 20 has for example four wires, namely two wires for transmission of the audio signal A and two wires for the voltage supply.

Figure 2:
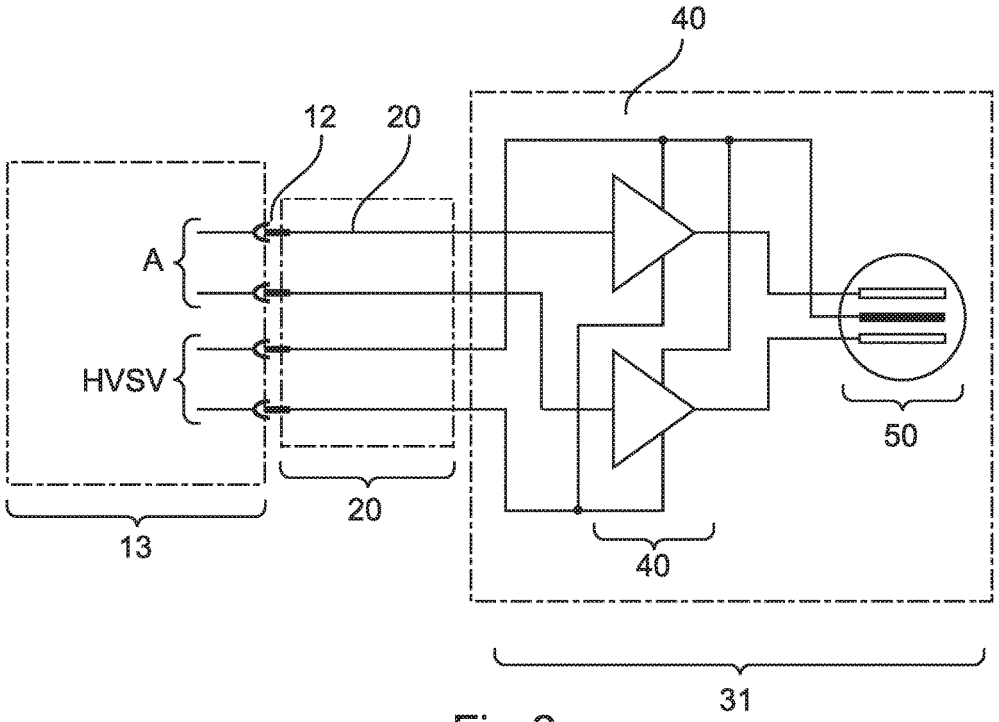
FIG. 2 shows a diagrammatic circuit of the pre-amplifier and the headphone according to the invention.

FIG. 2 shows a diagrammatic circuit of the pre-amplifier and the headphone according to the invention. The pre-amplifier 10 is in the form of a tube amplifier having a plurality of tubes 11 and amplifies the audio signal to be reproduced (for example by 10 times). If the audio signal A to be reproduced has a signal voltage of 500 mV then the voltage of the audio signal is amplified for example to 5V.

Provided in the headphone 30 is a second amplifier stage as a high-voltage amplifier stage 40 which by way of the cable 20 is supplied with a high-voltage supply involving the required high voltage HVSV. The audio signal A which is pre-amplified in the first amplifier stage 13 can then be further amplified for example in the second high-voltage amplifier stages 40. The gain can be for example 50 times so that the audio signal which is transmitted by way of the cable 20 and which is of a voltage of for example 5 volts is amplified to a voltage of for example 250 volts. That voltage can then be applied to the electrostatic transducer 50.

According to the invention the headphone 30 has two ear cups 31 or housings 31 for the electrostatic transducers. Thus there are two electrostatic transducers 50 in the headphone. Accordingly the headphone according to the invention also has (second) high-voltage amplifier stages 40.

Thus there is provided a headphone having two headphone capsules (left and right) or two electrostatic transducers, wherein associated with each electrostatic transducer 50 there is a (second) high-voltage amplifier unit 40. Those (second) high-voltage amplifier units 40 supply the symmetrically designed electrostatic sound transducers in the electrical push-pull mode of operation. Thus there is a respective amplifier for each of the two counter-electrodes.

According to the invention two signal voltages which are the same in opposite relationship (symmetrical) and which the pre-amplifier 10 outputs at its output 12 can be associated with each of the electrostatic transducers by way of the cable 20.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A headphone unit comprising:

a headphone;

a headphone pre-amplifier disposed outside the headphone; and a cable coupling the headphone pre-amplifier with the headphone;

wherein the headphone comprises:

two symmetrically designed electrostatic transducers in a push-pull mode of operation; and a high-voltage amplifier stage for each of the two symmetrically designed electrostatic transducers:

wherein each high-voltage amplifier stage is adapted to amplify an audio signal to be reproduced based on a high voltage supply;

wherein the headphone pre-amplifier comprises:

at least one tube configured to pre-amplify an audio signal to be reproduced; and an output adapted for coupling with the cable;

wherein the headphone pre-amplifier is adapted to output an audio signal to be reproduced as a voltage-amplified audio signal on a first voltage level at the output; and wherein the high-voltage amplifier stages for the two symmetrically designed electroacoustic transducers receive, via the cable, the voltage-amplified audio signal to be reproduced being on the first voltage level and the high-voltage supply, the high voltage supply being sufficiently high for the high-voltage amplifier stages for amplifying the audio signal to be reproduced from the first voltage level to a second voltage level that is about fifty times of the first voltage level.

2. The headphone unit as set forth in claim 1;

wherein the cable has:

two wires configured to transmit the pre amplified audio signal; and two wires configured to transmit the high-voltage supply.

3. The headphone unit as set forth in claim 1;

wherein the headphone pre-amplifier is configured to generate and provide two oppositely directed symmetrical signal voltages by way of the cable for each of the two symmetrically designed electrostatic transducers.

4. The headphone unit as set forth in claim 1;

wherein the headphone pre-amplifier is supplied with a supply voltage that is lower than the high-voltage supply.

5. The headphone unit as set forth in claim 1;

wherein the cable has a jack adapted for connecting to the output of the headphone pre-amplifier.

6. The headphone unit as set forth in claim 1;

wherein the headphone pre-amplifier has a jack for a user to connect the headphone pre-amplifier with an audio source.

7. The headphone unit as set forth in claim 6;

wherein the first voltage level is about ten times of a voltage level of audio data that is received via the input jack.

8. A headphone unit comprising:

a headphone pre-amplifier; and a headphone coupled with, via a cable, the headphone pre-amplifier, wherein the headphone pre-amplifier is disposed outside the headphone;

wherein the headphone comprises:

two symmetrically designed electrostatic transducers in a push-pull mode of operation; and a high-voltage amplifier stage for each of the two symmetrically designed electrostatic transducers;

wherein the high-voltage amplifier stages is adapted to amplify an audio signal to be reproduced based on a high voltage supply;

wherein the headphone pre-amplifier comprises:

at least one tube configured to pre-amplify an audio signal to be reproduced; and an output adapted for coupling with the cable;

wherein the headphone pre-amplifier is adapted to output an audio signal to be reproduced as a voltage-amplified audio signal on a first voltage level at the output; and wherein the high-voltage amplifier stages for the two symmetrically designed electro-acoustic transducers receive, via the cable, the voltage-amplified audio signal to be reproduced being on the first voltage level and the high-voltage supply, the high voltage supply being sufficiently high for the high-voltage amplifier stages for amplifying the audio signal to be reproduced from the first voltage level to a second voltage level, wherein the high-voltage supply is capable of producing a voltage of at least 250 Volts.

* * * * *